United States Patent [19]

Nomura et al.

[11] Patent Number: 4,722,288

[45] Date of Patent: Feb. 2, 1988

[54] SEWING MACHINE

[75] Inventors: Etsuzo Nomura, Kasugai; Yasuo Sakakibara, Hekinan; Tetsuo Kozawa, Toyoake; Yukio Nishida, Kuwana; Ikuzo Kondo, Chita, all of Japan

[73] Assignee: Brother Kogyo Kabushiki Kaisha, Nagoya, Japan

[21] Appl. No.: 840,120

[22] Filed: Mar. 14, 1986

[30] Foreign Application Priority Data

Mar. 20, 1985 [JP] Japan ..... 60-56419

[51] Int. Cl.[4] ..... D05B 19/00; D05B 27/22

[52] U.S. Cl. ..... 112/121.11; 112/275; 112/315

[58] Field of Search ..... 112/121.11, 121.12, 112/275, 277, 315, 314, 272, 262.1

[56] References Cited

U.S. PATENT DOCUMENTS 4,359,953 11/1982 Martell et al. ..... 112/121.11
4,381,719 5/1983 Goldbeck ..... 112/121.11
4,404,919 9/1983 Martell et al. ..... 112/272 X
4,495,877 1/1985 Willenbacher ..... 112/121.11
4,526,114 7/1985 Martell et al. ..... 112/121.11 X
4,555,997 12/1985 Tancs ..... 112/121.11
4,565,140 1/1986 Martell et al. ..... 112/121.11
4,583,476 4/1986 Fischer ..... 112/121.11 X

FOREIGN PATENT DOCUMENTS 53-38646 8/1978 Japan .

*Primary Examiner*—Peter Nerbun
*Attorney, Agent, or Firm*—Jordan and Hamburg

[57] ABSTRACT

The invention relates to a sewing machine provided with a needle reciprocated according to rotations of a main shaft and work feeding devices actuated synchronously with rotations of the main shaft, setting a margin to sew from a trailing edge to a sewing end position. The sewing machine includes devices for computing a terminal stitch length according to a set margin width. Control devices are provided for controlling a sewing to be carried out for coping with that which corresponds to the terminal stitch length computed by the computing device. The sewing machine further comprises computing devices for applying a correction to at least one of a number of stitches and a feed pitch, as occasion demands, where there arises the remainder as the result of an operation of the computing devices, and control devices for controlling the sewing to be carried out according to the computed result.

17 Claims, 27 Drawing Figures

SEWING MACHINE

BACKGROUND OF THE INVENTION

1. Field of the Invention

The present invention relates to a sewing machine upon which a sewing operation is carried out to secure a predetermined width of a margin to sew up according to a preset margin data.

2. Description of the Prior Art

As shown in FIG. 1, in case, for example, a pocket fabric piece 201 which is another work fabric is sewn on a work fabric 200 for the breast part of a garment or the like, a margin to sew has been secured so far as follows. That is, first a side edge portion 202 of the pocket fabric piece 201 is sewn so as to leave a required width of margin from the side edge 202, the sewing operation is stopped at a position where a required interval l is formed between the side edge portion 202 and another side edge portion 203 adjacent thereto, and then the sewing operation is kept going along the side edge portion 203. Accordingly, the interval may constitute a margin to sew for the side edge portion 203.

Thus each side edge portion of the pocket fabric piece 201 can be sewn securing a required width of margin therefor by repeating the above-described operation. However, it was difficult to keep the interval l constant for the reason that the first needle-drop position could not be kept constant, the work fabric expanded and contracted, and so forth. Thus the sewn goods cannot be finished uniformly, which may result in a depreciation of commercial value of the sewn goods.

To settle the above-mentioned situation, various types of sewing machines were hitherto proposed. These sewing machines are provided with a sensor for detecting the trailing edge of a work fabric on an up stream side of a needle, and a required width of the margin is secured by correcting terminal stitch length after detection of the trailing edge on the sensor. For example, a sewing machine provided with a correction unit for correcting a predetermined number of stitches is disclosed in U.S. Pat. No. 4,381,719. In this type of sewing machine, whether or not stiches are aligned duly will be decided according to a rotational phase of a main shaft at the time of trailing edge end detection on the sensor, and thus the number of stitches in the terminal stitch length is corrected accordingly thereto. Then, another sewing machine for correcting the length of one or plurality of stitches on an instantaneous needle position at the time of trailing edge detection is disclosed in West Germany Pat. No. 3,228,789. Further, such sewing machines as will secure a required width of margin to sew by applying a correction to the stitch number or length are also disclosed in Japanese Pat. Publication No. 38646/1978, U.S. Pat. No. 4,359,953, U.S. Pat. No. 4,404,919. However, in the prior arts, a margin to sew up is set as the frequency of needle drops unexceptionally from the time of trailing edge detection to the shutdown of a sewing machine. Accordingly, for setting a required width of margin, there yet needed is the operation wherein one stitch length is multiplied by the number of stitches at a terminal stitch length, and the value thus obtained is subtracted from the distance between a needle and a sensor, which is extremely troublesome.

SUMMARY OF THE INVENTION

An object of the invention is to provide a sewing machine which is ready for sewing operation simply from setting the width of a margin to sew only instead of setting the stitch number and length.

Another object of the invention is to provide such a sewing machine as is capable of correcting the discrepancy when the terminal stitch length is divided by the frequency of needle drops, i.e. a final needle drop position is discrepant from the set margin position.

A further object of the invention is to provide a sewing machine ready for changing the width of a margin to sew up arbitrarily.

Still further object of the invention is to provide a sewing machine whereon a sewing operation is carried out to correct the margin to sew up when the margin formed through sewing operation is discrepant from the preset one after the operation of the terminal stitch length is over.

In order to attain the foregoing objects, in a first viewpoint of the invention, the sewing machine comprises detecting means for detecting the trailing edge of a work fabric which is disposed on the up stream side of the reciprocating path of the needle, first setting means for setting a distance between the detecting means and the needle, second setting means for setting the width of a margin to sew up from the trailing edge of the work fabric to a sewing operation end position, computing means for computing a terminal stitch length after detection by the detecting means by subtracting the width of margin to sew up which is set by the second setting means from the distance set by the first setting means, and controlling means for controlling the sewing operation coping with the terminal stitch length computed by the computing means.

In order to attain the foregoing other object, in a second viewpoint of the invention, the sewing machine comprises feed adjusting means for adjusting the feed pitch by work feeding means to a basic pitch and other pitches, a data regulating means for regulating data corresponding to the feed pitch regulated by the feed adjusting means, detecting means for detecting the trailing edge of a work fabric which is disposed on the up stream side of the reciprocating path of the needle, first setting means for setting the distance between the detecting means and the needle, second setting means for setting a margin to sew from the trailing edge of the work fabric to a sewing end position, first computing means for computing a distance data from a point detected by the detecting means to a sewing end point, subtracting the width of margin to sew set by the second setting means from the distance set by the first setting means when the trailing edge is detected by the detecting means, and for computing the number of sewing end stitches after detection of the trailing edge by the detecting means according to the distance data and the feed pitch data regulated by the feed pitch data regulated means, second computing means for computing so as to apply a correction to at least one of the number of stitches and the feed pitch according to a size of the remainder, as occasion demands, where the remainder arises from a computation by the first computing means, and for closing and/or coinciding the actual sewing end position to a sewing end position set by the second setting means, and controlling means for controlling the sewing operation to be carried out as far as the set sewing end position according to results obtained by computation on the first and second computing means.

Further in order to attain the foregoing object, in a third viewpoint of the invention, the second setting means comprises means for making the margin to sew variable.

Still further, in a fourth viewpoint of the invention, the sewing machine comprises storage means for storing a data on terminal stitch length computed by the computing means, the controlling means for controlling the sewing operation to be carried out according to the stored data, and revising means for revising a data on margin to sew after the terminal stitch length sewing operation is over.

Other and further objects of the invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

One operative example of a sewing machine embodying the invention will now be described with reference to the accompanying drawings.

Figure 2:
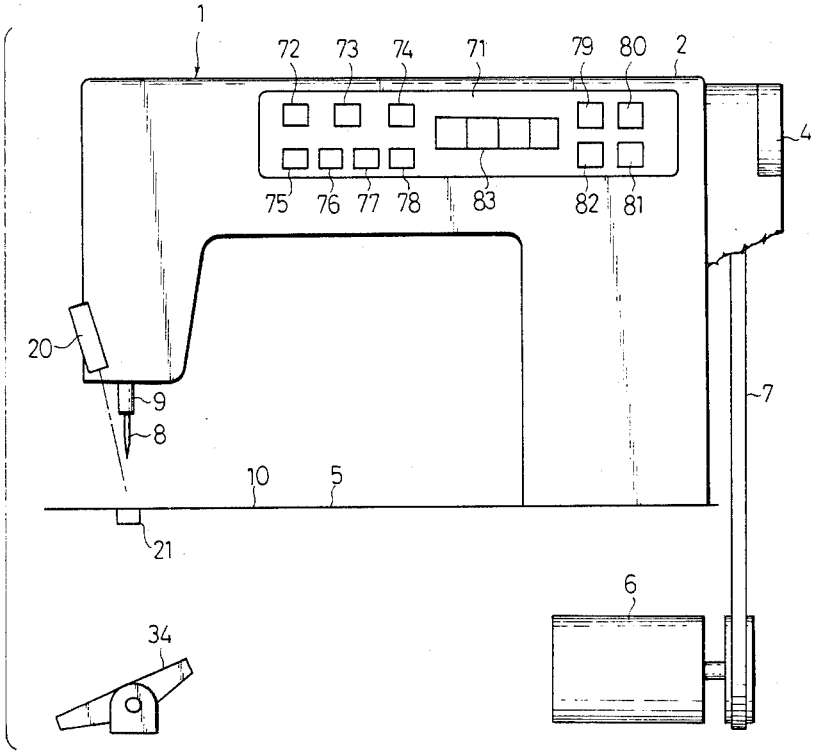
FIG. 2 is a schematic front view of a sewing machine.
Figure 3:
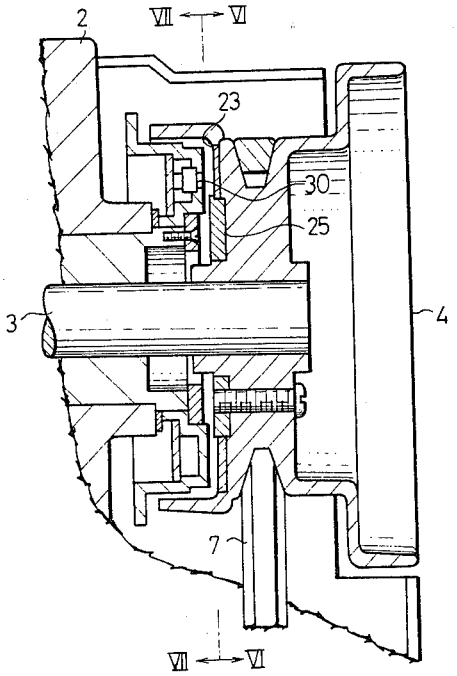
FIG. 3 is a sectional view of a driven pulley and its periphery.

As shown in FIG. 2 and FIG. 3, a main shaft 3 is supported rotatably on an arm part 2 of a sewing machine frame 1, and a driven pulley 4 is fixed on the right end portion. Then, a rotation of a motor 6 disposed under a bed part 5 of the sewing machine frame 1 is transferred to the main shaft 3 through a belt 7 and the driven pulley 4.

Figure 4:
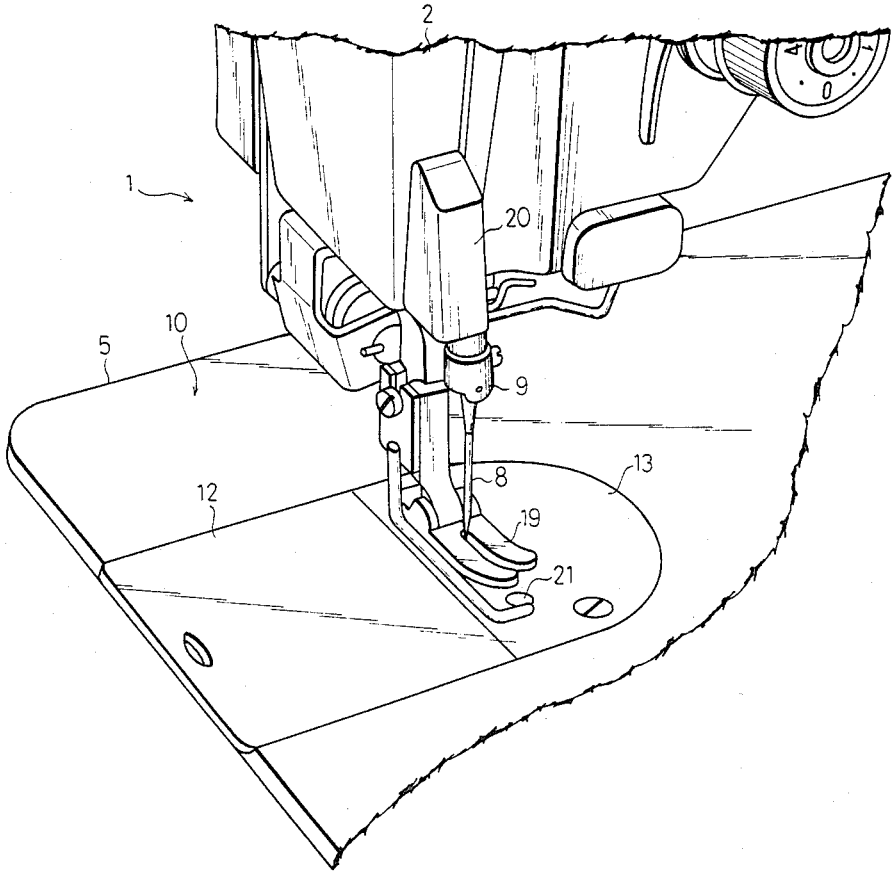
FIG. 4 is a fragmentary perspective view showing a sewing operation area peripheral of a needle.

As shown in FIG. 2 and FIG. 4, a needle bar 9 having a needle 8 is supported movably up and down on the arm part 2, and the needle 8 is moved vertically across a work supporting surface 10 of the bed part 5 according to a rotation of the main shaft 3. Then, an arrangement is such that a stitch is formed on a work fabric on the work supporting surface 10 through a cooperative operation between the needle 8 and a loop taker (not indicated) in the bed part 5. Stitch forming devices are constituted of the needle 8 and the loop taker.

Figure 5:
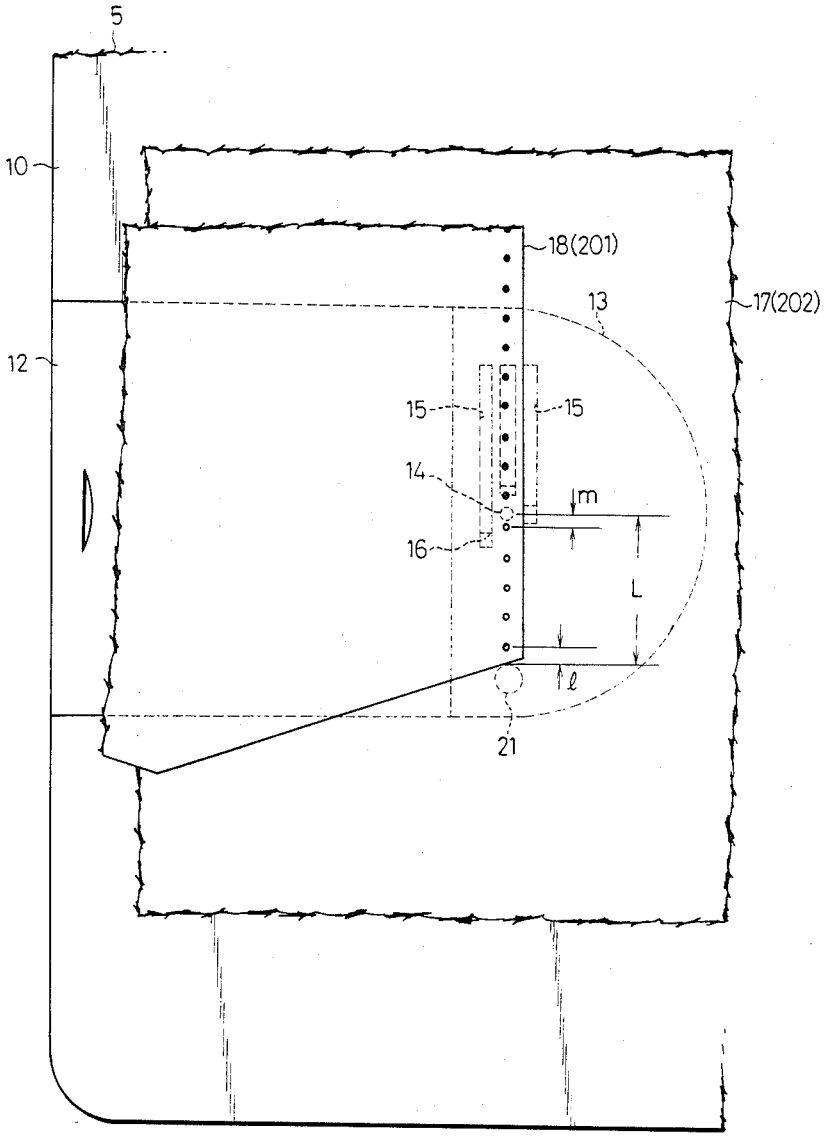
FIG. 5 is a fragmentary plan view showing a sewing state at the sewing operation area.

As shown in FIG. 4 and FIG. 5, a slide plate 12 and a needle plate 13 constituting a part of the work supporting surface 10 are installed on the bed part 5. A needle drop hole 14 permitting the needle 8 to pass and a plurality of feed dog openings 15 are formed on the needle plate 13. A feed dog 16 is disposed within the feed dog openings 15. A presser foot 19 for depressing work fabric 17, 18 on the work supporting surface 10 downward is disposed on the arm part 2 opposite to the feed dog 16. Work feeding means for feeding the work fabric 17, 18 intermittently are constituted of both the feed dog 16 and the presser foot 19.

A projector 20 positioned on the up stream side of the reciprocation path of the needle is mounted on a front of the arm 2. A light receiver 21 for receiving the light from the projector 20 is mounted on the bed part 5 at the up stream side of the reciprocation path of the needle. The light receiver 21 outputs a signal corresponding to the quantity of light received. Detecting means are constituted of the projector 20 and the light receiver 21.

Figure 6:
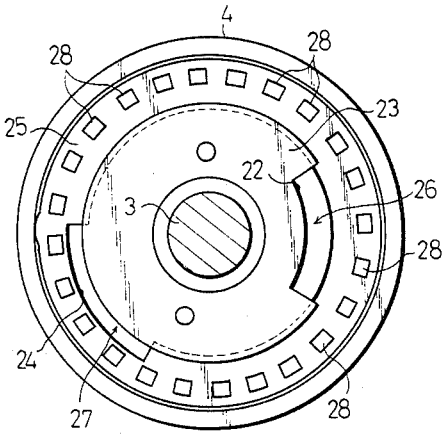
FIG. 6 is a sectional view taken on line VI—VI of FIG. 3.
Figure 7:
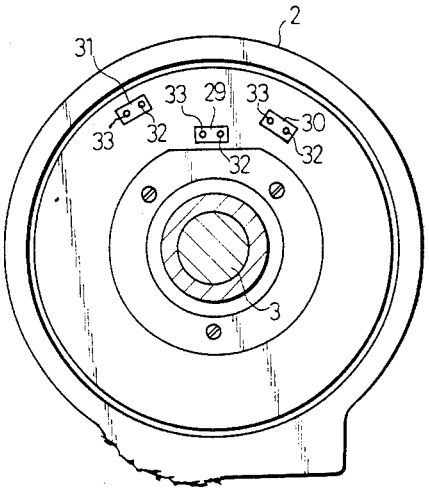
FIG. 7 is a sectional view taken on line VII—VII of FIG. 3.

As shown in FIG. 3, FIG. 6 and FIG. 7, a first reflecting plate 23 having a circular notch 22 on the outer periphery and a second reflecting plate 25 ring-shaped and having a notch 24 on the inner periphery are mounted on the left side surface of the driven pulley 4. Then, a portion divided by the notch 22 and an inner peripheral edge of the second reflecting plate 25 constitutes a non-reflective part 26 for detecting a top dead point of the needle. A portion divided by the notch 24 and an outer peripheral edge of the first reflecting plate 23 constitutes a non-reflective part 27 for detecting a bottom dead point of the needle. Further, a multitude of non-reflective faces 28 are formed at predetermined angular intervals on the surface of the second reflecting plate 25, thereby generating a synchronizing signal (timing pulse) which will be described hereinlater.

Figure 8:
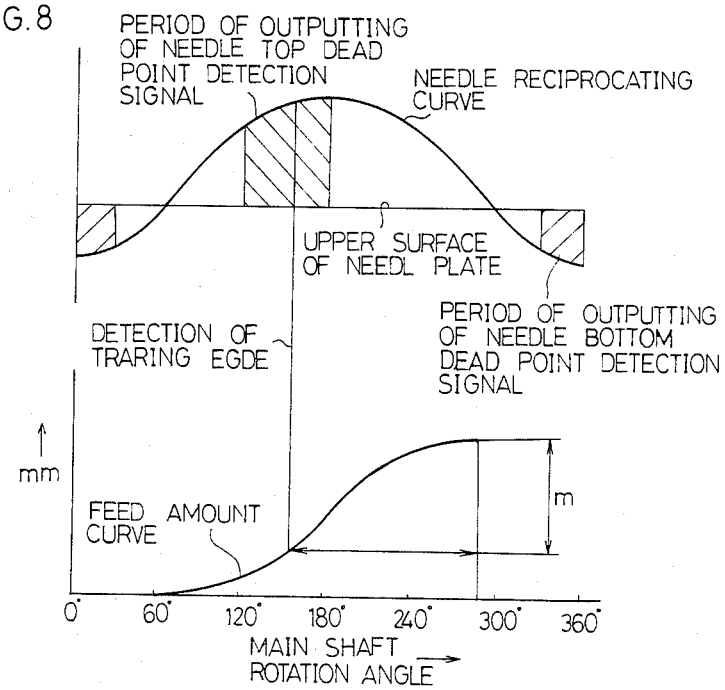
FIG. 8 is a diagram showing a needle reciprocation curve and a feed dog delivery curve in a sewing machine embodying the invention.
Figure 9:
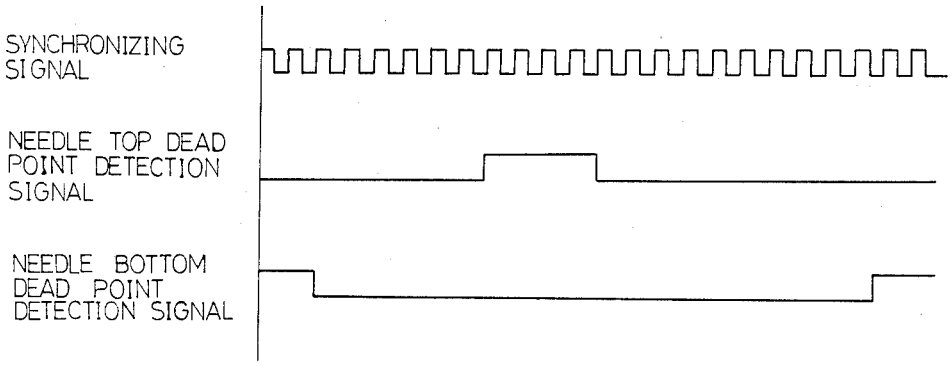
FIG. 9 is a time chart showing outputs of synchronizing signal, needle top dead point signal and needle bottom dead point signal.

A needle top dead point detector 29, a needle bottom dead point detector 30 and a synchronizing signal generator 31 are installed on the arm part 2 so as to each be opposite to a rotating path of the non-reflective faces 28 and the notches 22, 24. Each of the detectors 29, 30 and the synchronizing signal generator 31 are provided with a light emitting element 32 and a light receiving element 33, and the light from each light emitting element 32 is reflected by the reflecting plates 23, 24 and is incident on the light receiving element 33. Then, as shown in FIG. 8 and FIG. 9, when the needle 8 reaches the top dead point and the bottom dead point, the detectors 29, 30 come opposite to the non-reflective parts 26, 27, and thus detection signals are output. Then, a synchronizing signal is generated by the synchronizing signal generator 31 through an alternate passage of the non-reflective face 28 of the second reflecting plate 25 and a reflective face in accordance with a rotation of the driven pulley 4.

Figure 10:
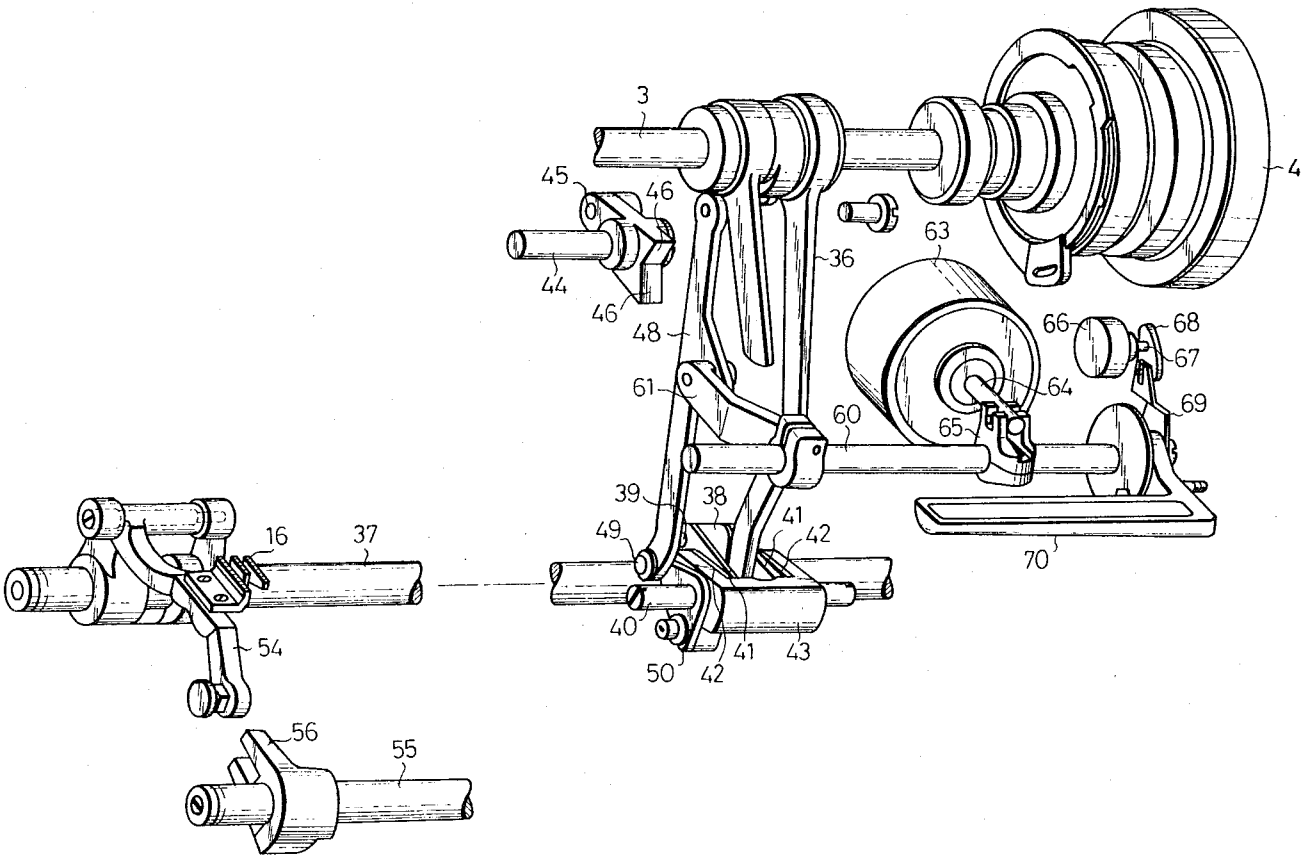
FIG. 10 is a perspective view, partly omitted, showing a feed motion generating unit and a feed amount detecting unit for detecting feed amount of work fabric.
Figure 12:
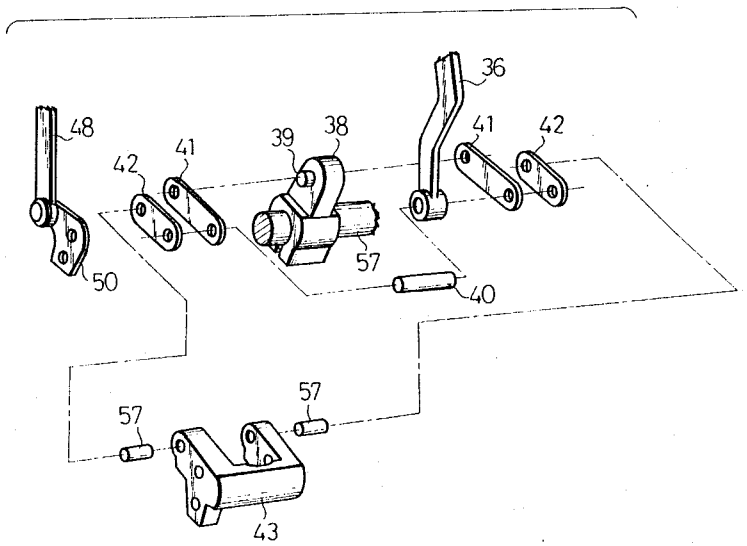
FIG. 12 is a fragmentary exploded perspective view showing a delivery adjust unit.
Figure 11:
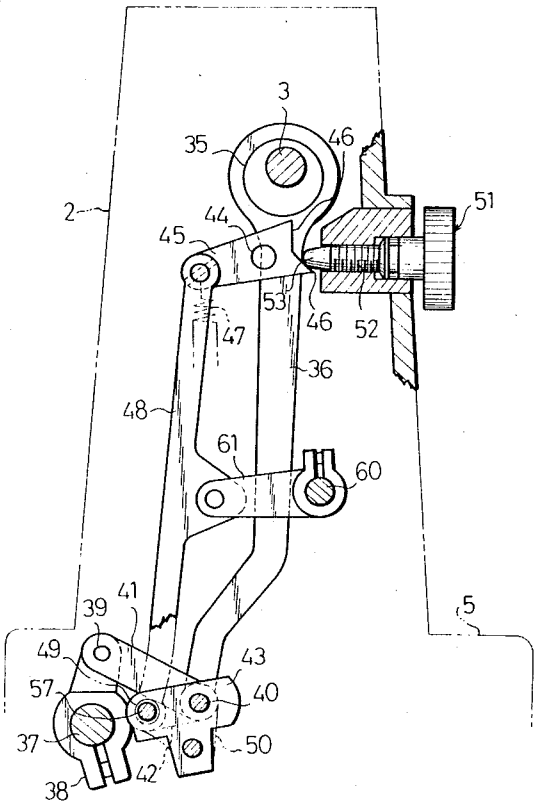
FIG. 11 is a fragmentary sectional view showing the feed motion generating unit.

As shown in FIG. 10 to FIG. 12, an eccentric cam 35 is fixed on the main shaft 3, and the upper end of a crank rod 36 is coupled embracingly to the outer periphery thereof. A horizontal feed shaft 37 is supported rotatably in the arm part 2 under the main shaft 3, and an oscillating arm 38 is fixed partly thereon. A pair of first links 41 are interposed between an upper shaft 39 of the oscillating arm 38 and a lower end shaft 40 of the crank rod 36. A pair of second links 42 are respectively supported rotatably at one end on the shaft 40. Another end of the second link 42 is coupled to a adjusting device 43 through a shaft 57.

A feed amount setter 45 is supported turnably by a shaft 44 somewhat below the main shaft 3, and a feed setting face 46 consisting of two cam faces symmetrical vertically is formed on the front thereof. The feed amount setter 45 is energized to turn counterclockwise of FIG. 11 by a spring 47. An upper end of a coupling rod 48 is coupled to the rear end of the feed amount setter 45. A coupling arm 50 is supported on a lower end of the coupling rod 48 through a pin 49 on almost the same axis as the shaft 57. The coupling arm 50 is fixed on the adjusting device 43. A manual adjusting member 51 is screwed and so supported on a casing of the arm part 2 at an intermediate screw 52, and an engaging projection 53 on its nose is engaged with the feed setting face 46 of the feed amount setter 45. An angle of inclination of the feed amount setter 45 is changed by a horizontal move of the engaging projection 53 according to a turning of the manual adjusting member 51. The feed dog 16 is fixed on a nose of the horizontal feed shaft 37 through a feed bar 54.

Then, the crank rod 36 is moved vertically by an action of the eccentric cam 35 according to a rotation of the main shaft 3, thus the first link 41 oscillates round the shaft 39, and the second link 42 and the adjusting device 43 oscillate round the shaft 57. In this case, if the shaft 57 is not located on a line connecting the shafts 39 and 40, then since the radiuses of the links 41, 42 are different, a swing is given to the oscillating arm 38 and a longitudinal move is given to the feed dog 16 through the horizontal feed shaft 37. Then, the angle of inclination of the feed setter 45 is changed by an adjustment of the manual adjusting member 51 through a cam action of the feed setting face 46. Angles of inclination of the second link 42 and the adjusting device 43 are changed consequently through the coupling rod 48, and a horizontal feed by the feed dog 16 is set renewedly. A forked arm 56 is fixed on a vertical feed shaft 55 parallel with the horizontal feed shaft 37. The forked arm 56 is engaged partly with the feed bar 54, and thus a reciprocation of the vertical feed shaft 55 is given to the feed dog 16 as a vertical move. The feed dog 16 thus operates for four-feed motion.

A feed adjusting shaft 60 is supported turnably on the arm part 2 between the main shaft 3 and the horizontal feed shaft 37, and is partly coupled to an intermediate portion of the coupling rod 48 through a coupling lever 61. A servo solenoid 63 is disposed near the feed adjusting shaft 60, and an armature 64 is coupled to a coupling arm 65 on the feed adjusting shaft 60. The feed adjusting shaft 60 is turned clockwise in FIG. 11 through the coupling arm 65 by projection of the armature 64 according to a drive of the servo solenoid 63. Then, the coupling rod 48 is moved upward through the lever 61 by turning of the feed adjusting shaft 60, angles of inclination of the second link 42 and the adjusting device 43 are changed, and thus the feed amount is reduced or the feed direction is reversed.

A potentiometer 66 functioning as a feed pitch data regulating means is disposed near an end portion of the feed adjusting shaft 60, a lever 68 on the input shaft 67 is coupled to a lever 69 on the feed adjusting shaft 60, thus detecting a turning of the feed adjusting shaft 60 or a feed pitch, and a signal according thereto is output. An operating lever 70 projecting outwardly of the front of the arm part 2 is coupled to the feed adjusting shaft 60. The feed adjusting shaft 60 is turned by manual operation of the operating lever 70.

As shown in FIG. 2, an operating panel 71 is mounted on the front of the arm part 2. There disposed on the operating panel 71 are memory key 72, workpiece thickness sensing key 73, reproducing key 74, pattern assignment keys 75 to 78, margin setting key 79, margin addition key 80, margin subtraction key 81, revising key 82, and display 83, these functioning as described hereinafter.

Figure 13:
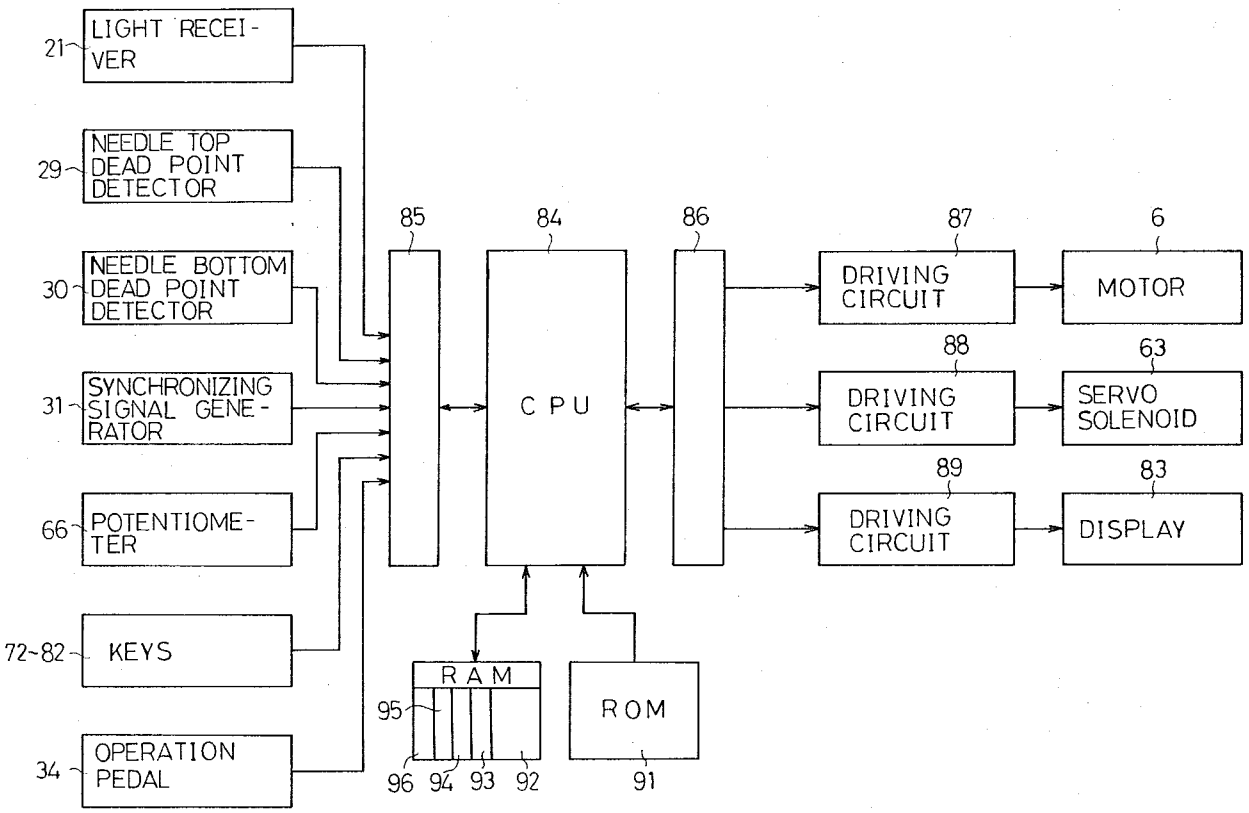
FIG. 13 is a block diagram showing an electrical configuration of the sewing machine.
Figure 14:
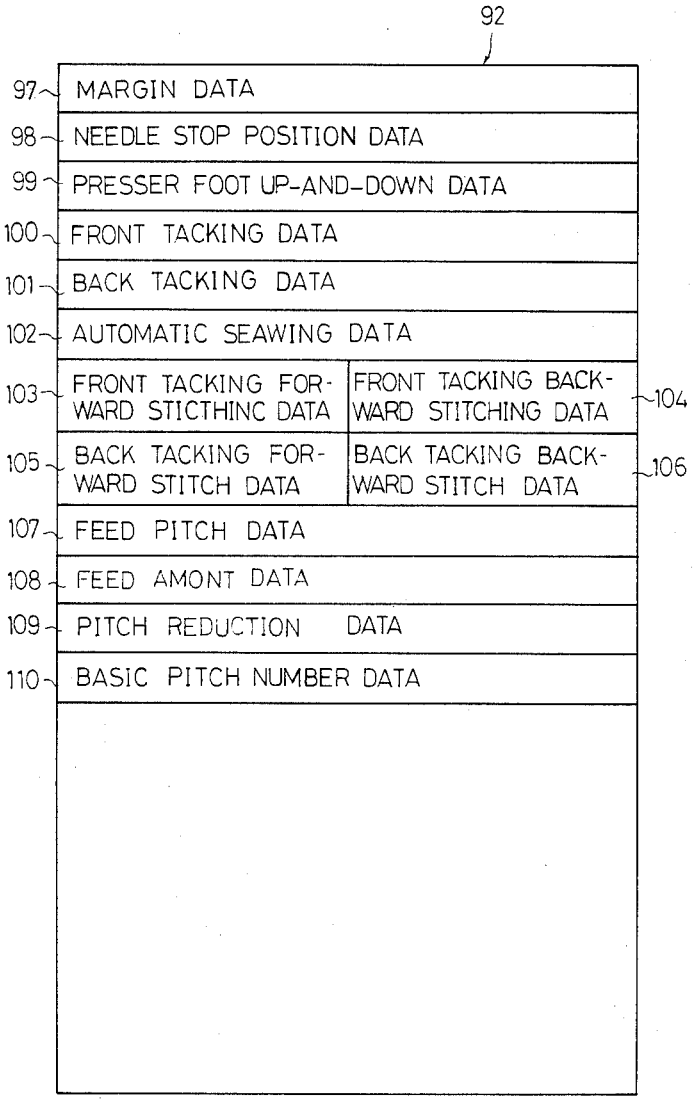
FIG. 14 is an explanatory drawing showing RAM map.

Next, as shown in FIG. 13, a sewing machine controlling circuit in the example will be described. Light receiver 21, keys 72 to 82, needle top dead point detector 29, needle bottom dead point detector 30, synchronizing signal generator 31, potentiometer 66, and operating pedal 34 are connected each to an input interface 85 of a central processing unit (CPU) 84 as a control means, and various signals are inputted therefrom. Sewing machine motor 6, servo solenoid 63 and display 83 are connected to an output interface 86 of CPU 84 through driving circuits 87, 88, 89, and CPU 84 outputs driving signals thereto. Then, CPU 84 is provided with a random access memory (RAM) 90 and a read-only memory (ROM) 91 as the first setting means for setting a distance L between the light receiver 21 and the needle 8. RAM 90 has a working area 92 and memory areas 93 to 96 corresponding to the pattern assignment keys 75 to 78 respectively. As shown in FIG. 14, the working area 92 has a margin data domain 97, a needle stop position data domain 98, a presser foot up-and-down data domain 99, a front tacking data domain 100, a back tacking data domain 101, an automatic sewing data domain 102, a front tacking forward stitch number data domain 103, a front tacking backward stitch number data domain 104, a back tacking forward stitch number data domain 105, a back tacking backward stitch number data domain 106, a one feed pitch (one seam length) data domain 107, a feed amount data domain 108, a pitch reduction data domain 109, a basic pitch number data domain 110. These functions will be made clear from a description given hereinafter. Further, there stored in ROM 91 are a program for controlling a general operation of the sewing machine, a workpiece feed amount data according to an angle of rotation of the main shaft 3 which is represented by a feed curve of FIG. 8, a distance data L between the light receiver 21 and the needle drop point as shown in FIG. 5, and a corrected number of stitches N (3 in the example) at the time of end of a sewing operation.

Next, an action of the sewing machine constituted as above will be described according to FIG. 15, FIG. 16, FIG. 17, FIG. 18 and FIG. 19. Programs given in flowcharts of FIG. 15 to FIG. 18 will proceed under control of CPU 84.

Figure 1:
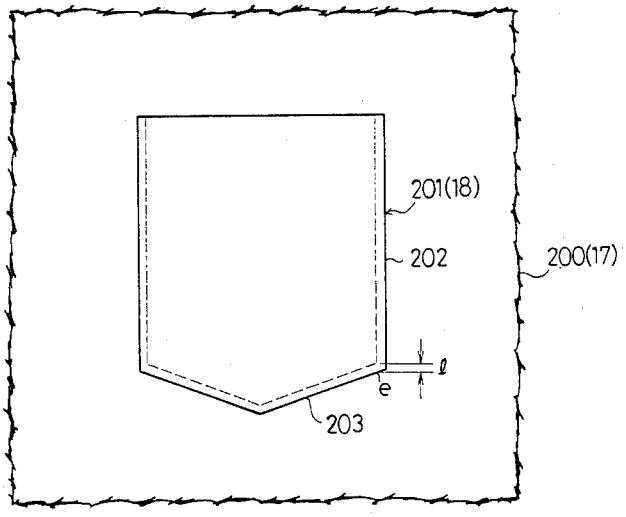
FIG. 1 is a front view showing a work fabric on which a pocket workpiece is sewn.

Now, as shown in FIG. 1 and FIG. 5, in case the pocket workpiece 18 which is another work fabric is placed on the work fabric 17, and a sewing operation is effected along a side edge of the pocket workpiece 18, the power of the sewing machine is first turned on. Thus in a step S1 shown in FIG. 15, CPU 84 waits for the memory key 72 to be on, and when the memory key 72 is on, it waits for any of the pattern assignment keys 75 to 78 to be on in the next step S2, an on operation of any one key is ready for proceeding to a step S3, where it waits for the margin setting key 79 to be on, and when the margin setting key 79 is subjected to an on operation, CPU 84 writes data that the margin is 0 mm in the margin data domain 97 of the working area 92 of RAM 90. In a step S4, the written data is displayed on the display 83 at the same time, and then the program proceeds to a step S6.

In the step S6, whether or not the margin addition key 80 is subjected to an on operation is discriminated, and when YES, CPU 84 writes a margin addition data for predetermined distance (data for the margin being 0.1 mm in the example) in the margin data domain 97 of the working area 92 in a step S7, and the result is displayed on the display 83 at the same time; in the case of NO where the on operation of the margin addition key 80 is not carried out, it skips the step S7 to proceed to a step S8, where whether or not an on operation of the margin subtraction key 81 is carried out is discriminated, and if YES, then a step S9 ensues, a margin subtraction data for a predetermined distance (data for the margin 0.1 mm subtracted in the example) is written in the margin data domain 97, and the result is displayed on the display 83 accordingly. Then, when it is discriminated that the on operation of the margin subtraction key 81 has not been carried out in the step S8, it skips the step S9 and proceeds to a step S10. In the step S10, whether or not the operating pedal 34 is turned on is discriminated, and where not on, it returns to the step S6. Accordingly, a scanning round the steps S6 to S10 is kept up until the operating pedal 34 is operated. Therefore, the operator is capable of setting an arbitrary width of margin to sew (l in FIG. 5) and storing it in the margin data domain 97.

In the step S10, when the operating pedal 34 is operated, the program proceeds to a step S11, and a sewing operation on the sewing machine is commenced at a feed pitch (being a basic pitch P which will be described hereinlater) preset by the manual adjusting member 51. Then in the next step S12, the feed pitch at one stitch is detected by a signal from the potentiometer 66, and the data is written in the feed pitch data domain 107 of the working area 92. In the next step S13, CPU 84 waits for the light receiver 21 to detect an end portion (e, for example, in FIG. 1) of the pocket workpiece 18 according to a change in the quantity of light transmitted, and then proceeds to a step S14 upon detection.

Figure 17:
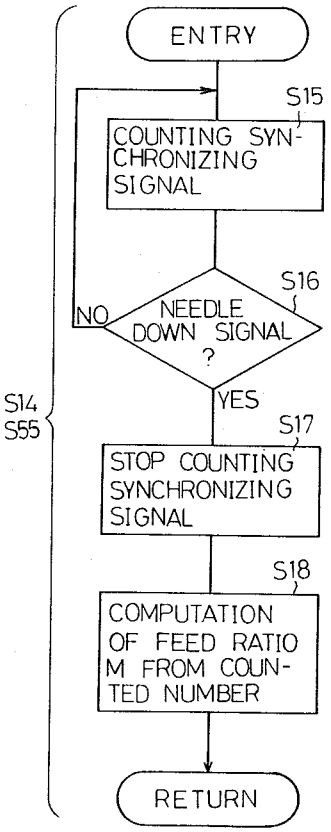
FIG. 17 is a flowchart showing a subroutine for detecting a feed phase at the time of trailing edge detection.
Figure 19:
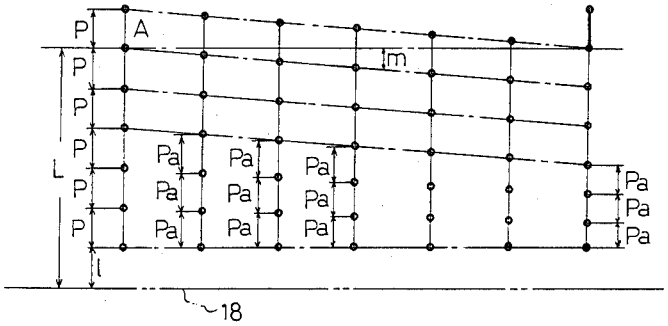
FIG. 19 is an explanatory drawing showing stitches formed according to the routine of FIG. 18.

In the step S14, as shown in FIG. 17, a pulse number of the synchronizing signal shown in FIG. 9 is counted in the looping subroutine steps S15 and S16, and when a needle bottom dead point signal is detected, i.e. at the time of a first needle drop after the trailing edge of the work fabric is detected, a counting of the synchronizing signal is stopped in the next step S17, CPU 84 computes a feed amount m of the work fabrics 17, 18 shown in FIG. 5 and FIG. 19 upon comparison of the feed amount data stored in ROM 91 shown in FIG. 8 with the count number in a step S18, and then writes it in the feed amount data domain 108 of the working area 92. The feed amount m is computed as 0.5, for example, with the ratio to the basic pitch 1 given as M, and the value is written in the feed amount data domain 108. Then, a black circle and a white circle indicated in FIG. 5 and FIG. 19 denote needle drop points before and after stitch formation respectively.

Figure 15:
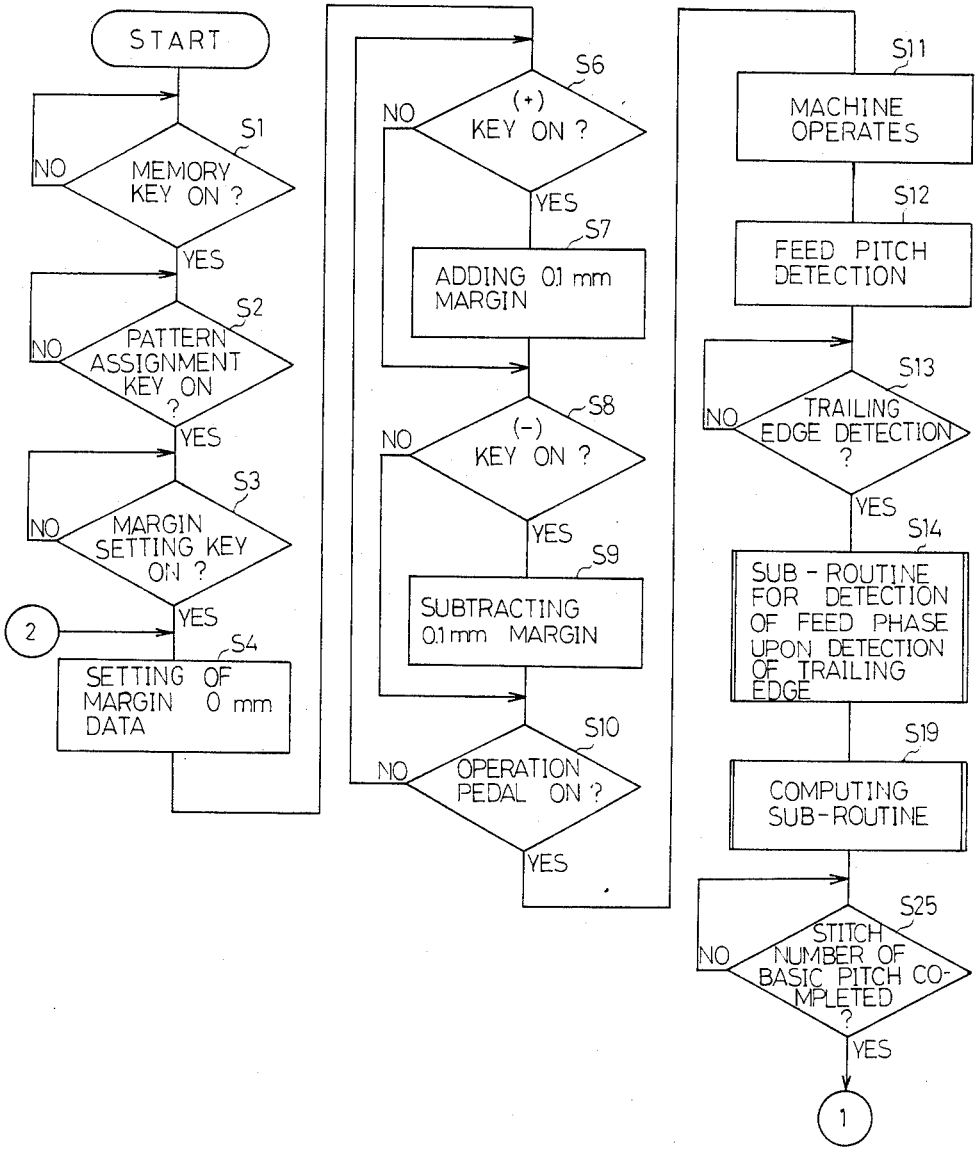
FIG. 15 is a flowchart showing nearly the first half routine for setting a data on margin to sew up.
Figure 18:
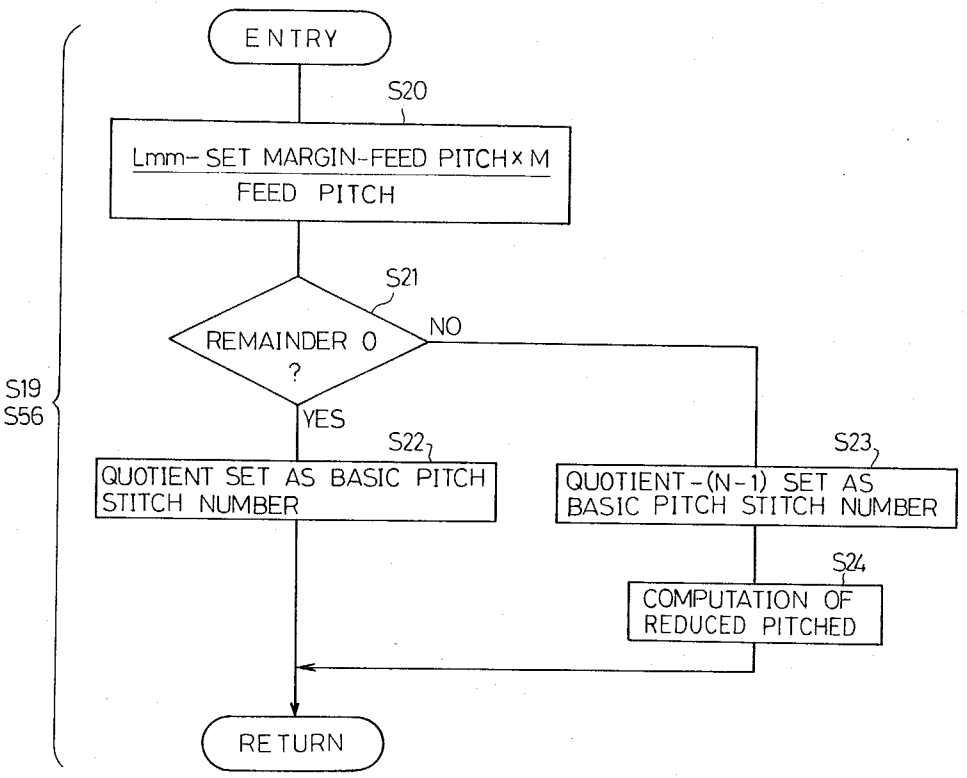
FIG. 18 is a flowchart showing a subroutine for computing a terminal stitch length according to a corrected number of stitches set beforehand.

Next, the program proceeds to a step S19 shown in FIG. 15. In the step S19, as shown in FIG. 18, the set margin and the product of the basic feed pitch and the feed ratio M are subtracted from the distance data L between the light receiver 21 and the needle drop point by CPU 84 in a step S20, the value is then divided by the basic feed pitch, and consequently in case a remainder of the quotient is discriminated as 0 (a portion A, for example, in FIG. 19) in a step S21, i.e. the quotient is integral or the terminal stitch length may be sewn only on the basic pitch, the program proceeds to a step S22 and the quotient obtained through the above computation is set as the number of stitches in the basic pitch P, which is written in the pitch reduction data domain 109 of the working area 92 as "not reduced". Then, in case the discriminated result in the step S21 is NO, i.e. the feed pitch must be corrected in a sewing of the terminal stitch length, the program proceeds to a step S23, where a value of the corrected number N of stitches, i.e. the difference obtained through subtracting 1 from 3 is subtracted from the above quotient, the integral value is identified with the basic pitch stitch number P, which is written in the basic pitch number data domain 110, and in the next step S24, it is written in the pitch reduction data domain 109 as "reduced", and a reduced pitch Pa of the corrected number of stitches is computed from remainder of the quotient and written in the feed pitch data domain 107. That is, in the step S24, the remainder is divided by the value of corrected number of stitches, and the quotient is subtracted from the basic pitch length P.

Figure 16:
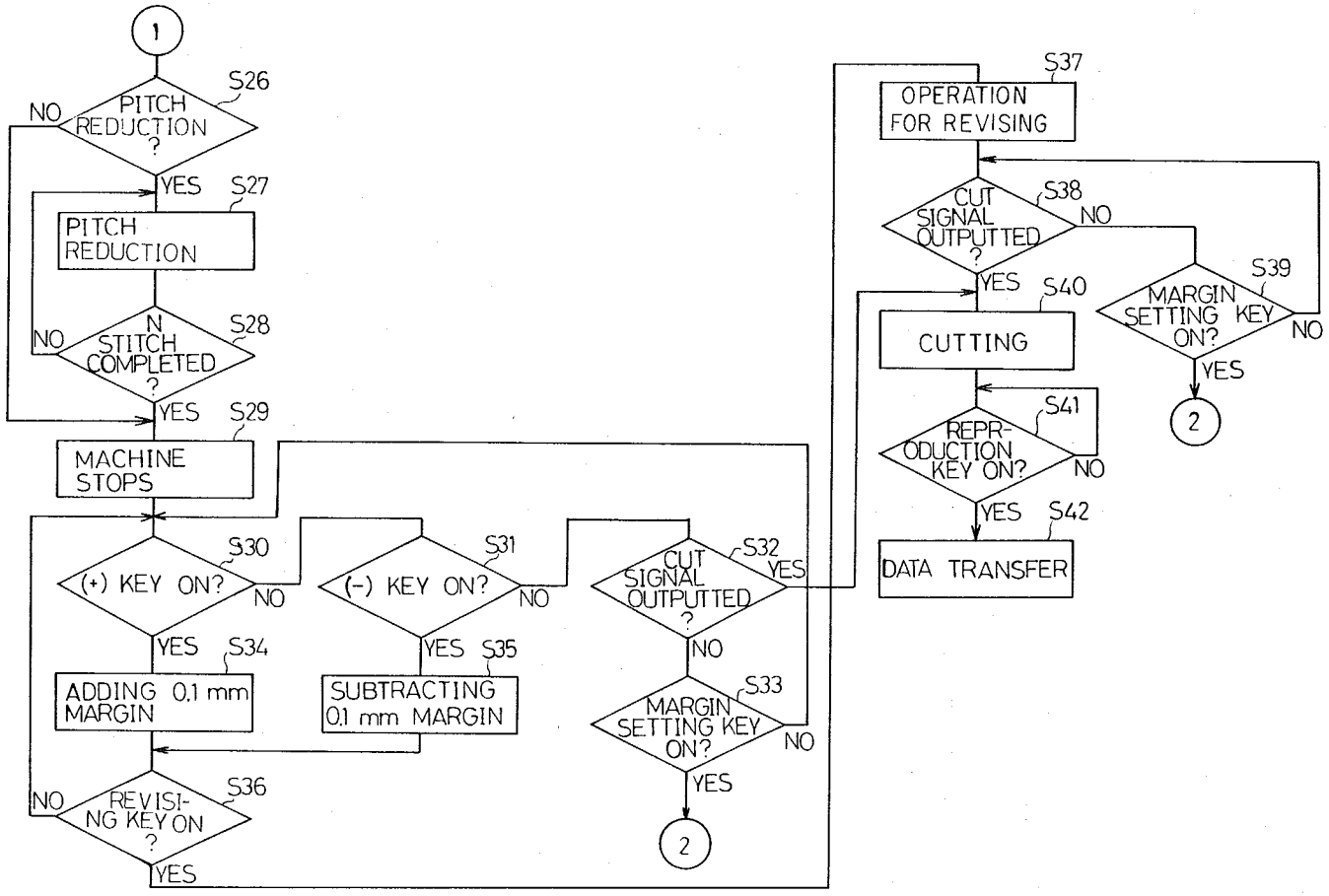
FIG. 16 is also a flowchart showing nearly the latter half routine.

The program then returns to a main routine shown in FIG. 15, whether or not the stitches in the basic pitch P come to end is discriminated in a step S25, and upon ending it proceeds to a step S26 shown in FIG. 16, CPU 84, reads a data from the pitch reduction data domain 109 and discriminates whether or not a pitch reduction is necessary, and if YES, then it proceeds to a step S27, where CPU 84 outputs a predetermined signal for control of the servo solenoid 63, the armature 64 of the servo solenoid 63 projects to turn the feed adjusting shaft 60, an inclination of the adjusting device 43 is thus changed through the coupling lever 61 and the coupling rod 48, and the feed amount per pitch is reduced (Pa of FIG. 19).

Then in a step S28, whether or not a sewing of stitches of the corrected number N (3 in the example) ends is discriminated, and if NO, then it returns to the step S27, and a looping of the step S27 and the step S28 is carried out.

When the N-stitch sewing ends, it proceeds to a step S29 and the sewing machine is shut down. As the matter of course, where the remainder is zero in the step S21, a discriminated result in the step S26 comes to YES, and the sewing machine is shut down without pitch reduction. In the next step S30, whether or not the margin addition key 80 is subjected to ON operation is discriminated, and if NO, then it proceeds to a step S31, where whether or not the margin subtraction key 81 is operated is discriminated, and if NO, it proceeds to a step S32 and whether or not a thread cut signal according to an operation of the operating pedal 34 is output is discriminated, and if NO, then it further proceeds to a step S33, where whether or not the margin setting key 79 is operated is discriminated, and if still NO, the program returns to the step S30. Accordingly, the state is ready for operation of any of margin addition key 80, margin subtraction key 81, operating pedal 34 and margin setting key 79, and thus the operator will decide whether or not the margin width is proper according to a position of the last stitch. In case, therefore, the margin addition key 80 or the margin subtraction key 81 is subjected to ON operation, an addition data or a subtraction data for the margin 0.1 mm will be written in the margin data domain 97 of the working area 92 in a step S34 or a step S35 respectively.

When the data is written as described above, the program proceeds to a step S36, where whether or not the revising key 82 is switched on is discriminated, and if NO, then it returns to the step S30 to execute the above-mentioned scanning.

Then, in case the operator decides that the margin is proper in the scanning round the steps S30 to S33 and thus operates the margin setting key 79 without subjecting both the margin addition and subtraction keys 80, 81 to on operation, the program returns to the step S4 of FIG. 15 and a new margin 0 mm data is set. Accordingly, an arbitrary width of margin at a separate sewing part can be set in the flow as above-mentioned. Further, in case the sewing ends and a revision of the margin is not required in the steps S30 to S33, the operator will tread the operating pedal 34. A thread cut signal is output therefor, discriminated result in the step S32 comes to YES, and the thread is cut in a step S40.

On the other hand, when the operator operates the revising key 82 after writing a required quantity of addition or subtraction data in the margin data domain 97, the program proceeds from the step S36 to a step S37, the workpiece is fed so much that the data is revised in the forward or reverse direction in the step S37, and the sewing is carried out further for one stitch. Then, CPU 84 waits for output of a thread cut signal according to a tread of the operating pedal 34 or on operation of the margin setting key 79 in steps S38, S39. In case the operating pedal 34 is trod according as the sewing ends, the thread cut signal is output and the thread is cut in the step S40. Where the margin setting key 79 is operated, the program returns to a step S41, which is ready for setting a new margin. Thus, the right side edge portion of the pocket workpiece 18 shown, for example, in FIG. 1 can be sewn so as to leave a margin therefor.

When the thread is cut, i.e. a sewing of one pattern is over, an operation of the reproducing key 74 is awaited in the step S41, and when so operated, data concerning the sewing of each side edge portion which is written in the working area 92 in a step S42 is transferred to the memory areas 93 to 96 of RAM 90 specified by any of the pattern assignment keys 75 to 78.

Figure 20:
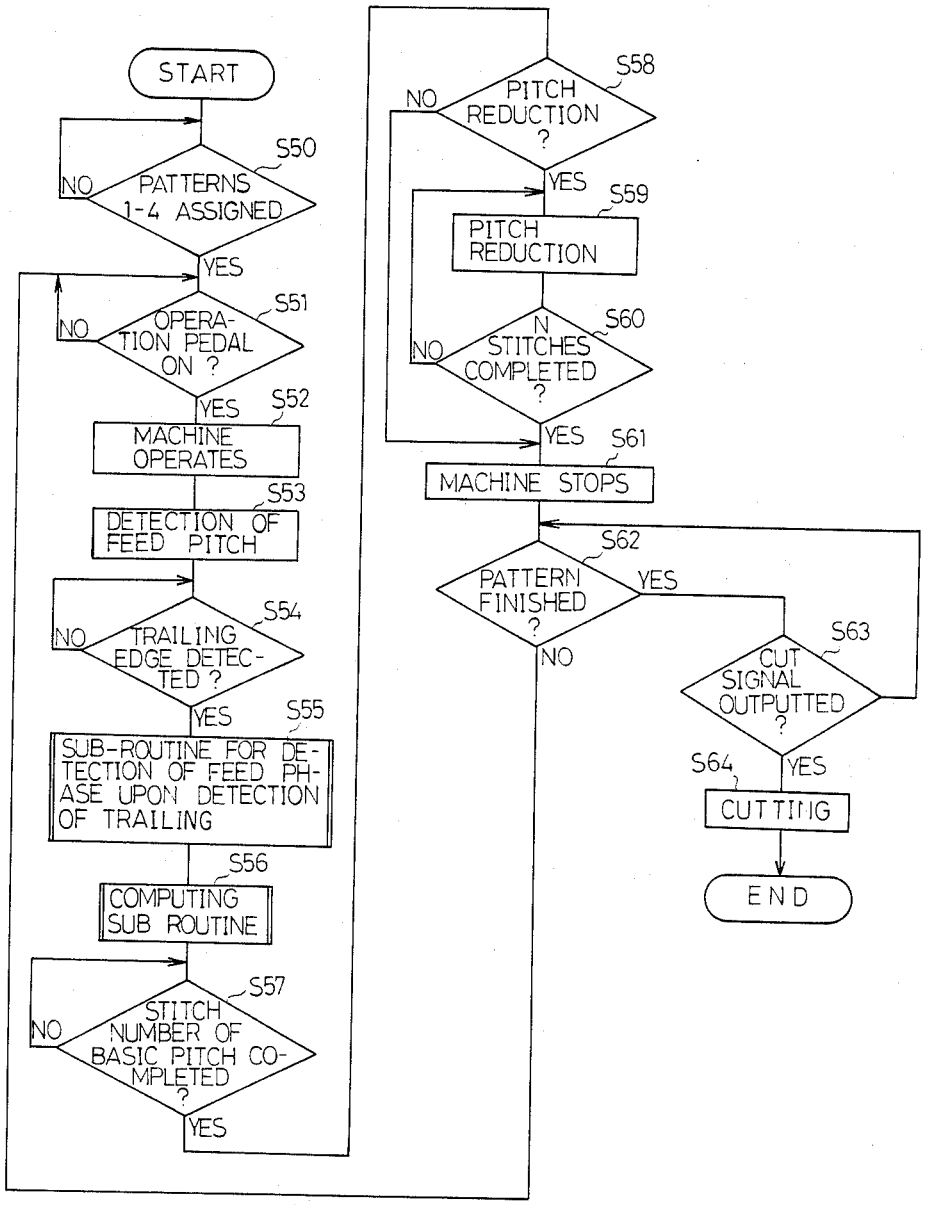
FIG. 20 is a flowchart showing a sewing routine after a margin to sew up is set.

Next, the case wherein a sewing is carried out according to a data written in any of the memory areas 93 to 96 will be described. In this case, whether or not a required pattern by any of the pattern assignment keys 75 to 78 is assigned is discriminated in a step S50 as shown in FIG. 20, and if YES, the program proceeds to a step S51 to wait for on operation of the operating pedal 34, and proceeds further to a step S52 upon operation, thus commencing an operation of the sewing machine. Then, in the program covering steps S53 to S61, a content almost similar to the program covering the steps S12 to S29 shown in FIG. 15 and FIG. 16 is executed. That is, a basic pitch is detected in the step S53, a detection of the trailing edge is awaited in the step S54, and whenever it is detected, the program proceeds to the step S55 to compute a ratio M of the length to the first stitch after detection of the trailing edge to the basic pitch in the subroutine shown in FIG. 17, whether or not a corrected number of stitches computed in the step S56 and a reduced pitch are also computed in the step S56 in the subroutine shown in FIG. 18, whether or not the basic pitch of stitches are over is discriminated in the step S57, the program then proceeds to the step S58 upon discrimination, whether or not the pitch must be reduced is discriminated in the step S58, and if YES, the work fabric is sewn for the corrected number of stitches in the scanning round steps S59 and S60. Where the discrimination results in NO in the step S58, the sewing machine is shut down in a step S61 if a discriminated result in the step S60 indicates YES.

In the next step S62, the pattern comes to end and whether or not the side edge portion of the pocket workpiece 18 has all been sewn is determined, and if NO, then the program returns to the step S51 to recommence sewing according to the pattern data. Then, in case a necessary sewing to the pocket workpiece comes to end, it proceeds to a step S63 from the step S62, an output of the thread cut signal is awaited in the scanning round the steps S62, S63, and the thread is cut upon output in a step S64. As described, the side edge portion of the pocket workpiece is automatically sewn according to an on operation of the operating pedal 34 from the second time on, and the stitch is corrected automatically, if necessary, to secure the required width of margin to sew at all times.

Figure 22:
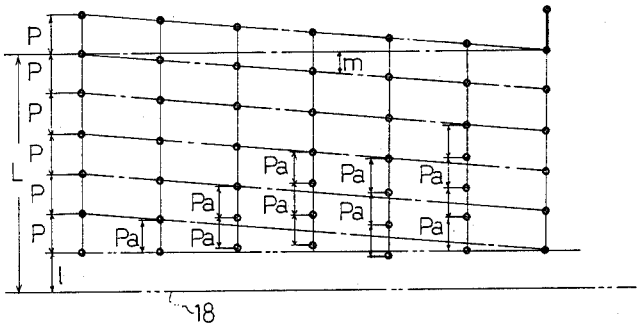
FIG. 22 is an explanatory drawing showing stitches formed according to the routine of FIG. 21.
Figure 21:
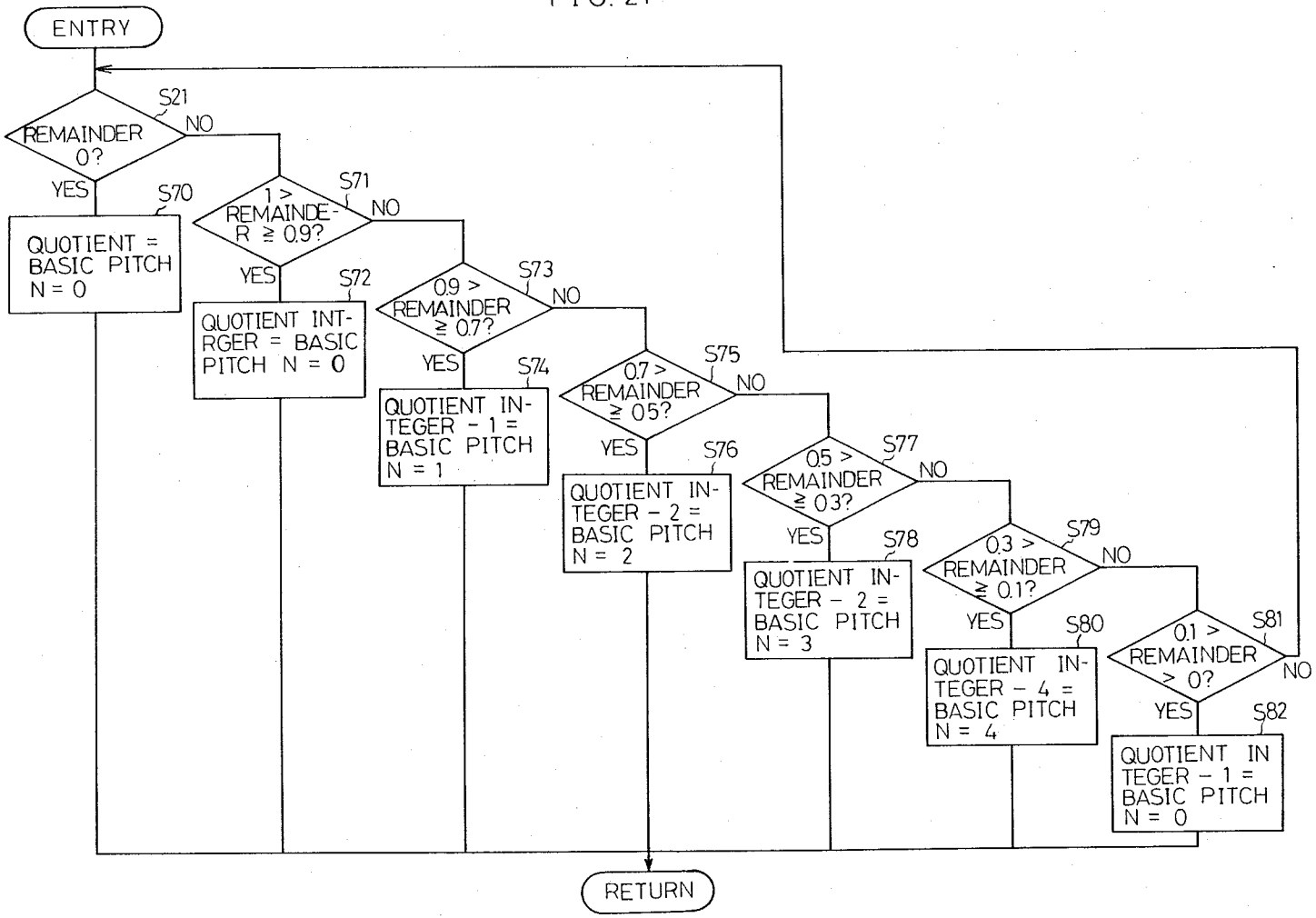
FIG. 21 is a flowchart showing a subroutine for computing a corrected number of stitches with a reduction rate determined therefor.

Next, a second illustrative example of the invention will be described with reference to FIG. 21 and FIG. 22. In the second example, the reduction rate of the feed pitch is fixed, and the margin is corrected by adjusting a corrected number of stiches at the same time, and the corrected number N of stitches is set through arithmetic operation of CPU 84. That is, where discrimination in the step S21 in FIG. 18 results in YES, the program proceeds to a step S70, where the quotient in the step S20 is set as a basic pitch number of stitches, and the corrected number N of stitches is set at zero. In case then a discriminated result in the step S21 is NO, it proceeds to a step S71, where whether or not the remainder of the quotient is 0.9 or over but less than 1 is discriminated. If the result is YES, the program proceeds to a step S72. Since a value of m is small in this case, i.e. there is hardly observed a gap at the time of trailing edge detection and at the time of first needle drop after the trailing edge is detected, the corrected number of stitches is set at 0, and the quotient integral number is set as a number of stitches of the basic pitch P. Then, where a discriminated result in the step S71 indicates NO, it proceeds to a step S73, where whether or not the remainder of the quotient is 0.7 or over but less than 0.9 is discriminated, and if YES, it proceeds to a step S74, the quotient integral number minus 1 is set as a number of stitches of the basic pitch P, and the corrected number N of stitches is set at 1. Thus, the discriminated result in any of steps S75 to S79 comes to YES according as the value of m gets large, the basic pitch number of stitches decreases one by one, the corrected number N of stitches increases one by one, and in case a discriminated result in a step S81 is YES, the quotient integral number minus 1 indicates the basic pitch number of stitches, and the corrected number of stitches is not set. Then, in case the discriminated result in the step S81 is NO, the program returns to the step S21.

Figure 23:
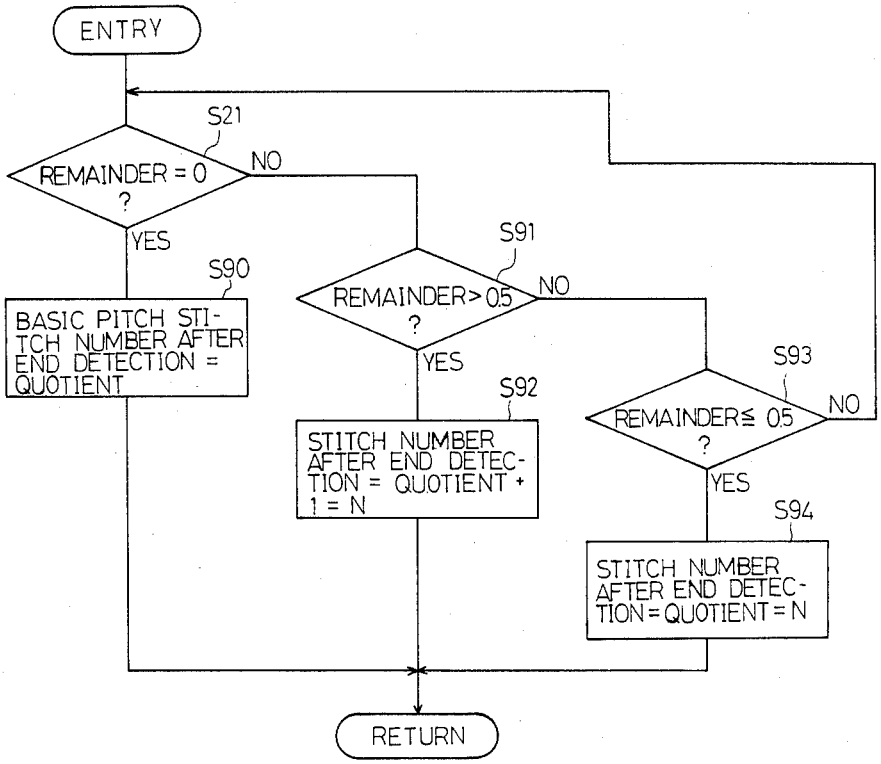
FIG. 23 is a flowchart showing a subroutine for determining a reduction rate of the total number of stitches after trailing edge detection and computing a corrected number of stitches according to the reduction rate.
Figure 24:
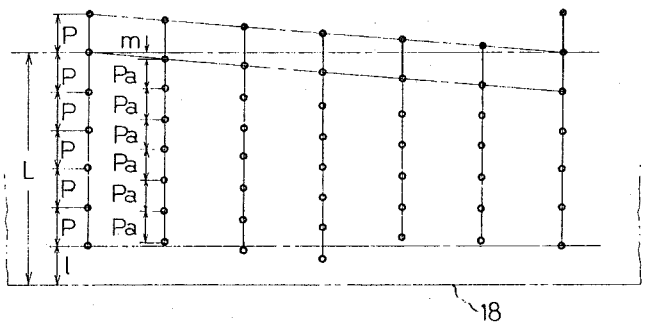
FIG. 24 is an explanatory drawing showing stitches formed according to the routine of FIG. 23.

Next, a third illustrative example of the invention will be described with reference to FIG. 23 and FIG. 24. In the third example, the correction is made with the reduction rate fixed, and the corrected number N of stitches is set through computing operation of CPU 84. If a discriminated result in the step S21 is YES, the quotient is set as a basic pitch number of stitches after end portion detection in a step S90, and where the discriminated result is NO, whether or not the remainder of the quotient is over 0.5 is discriminated in a step S91, but if YES, the program proceeds to a step S92, where the number of stitches after trailing edge detection is set at quotient plus 1, which are all set as the corrected number N of stitches, and if NO, then the program proceeds to a step S93, where whether or not the remainder of the quotient is 0.5 or below is discriminated, but if YES, a value of the quotient is set as the corrected number N of stitches in a step S94.

Figure 25:
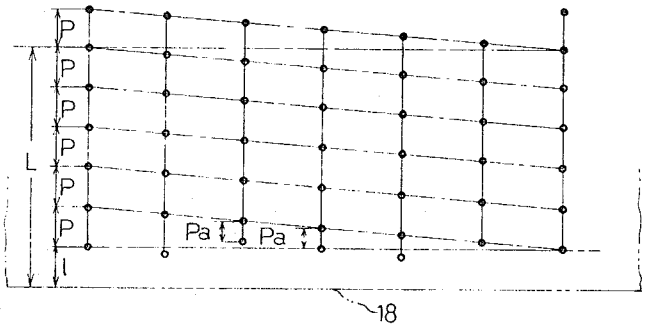
FIG. 25 is an explanatory drawing showing stitches with a margin to sew up corrected where the reduction rate of a final stitch is made constant.
Figure 26:
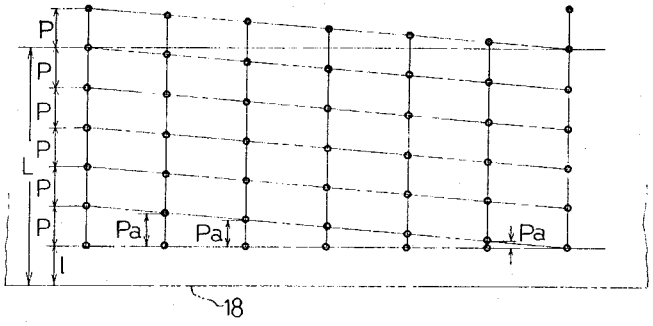
FIG. 26 is an explanatory drawing showing stitches with a margin to sew up corrected therefor where the reduction rate of a final stitch is made variable.
Figure 27:
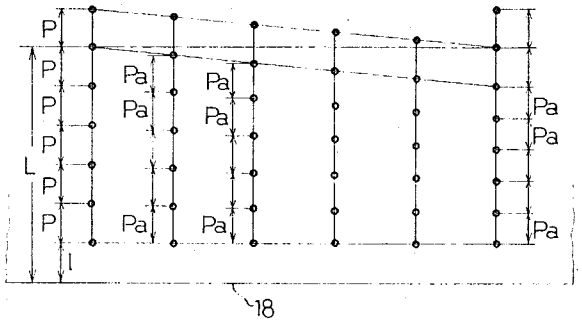
FIG. 27 is an explanatory drawing showing stitches with a margin to sew up corrected therefor where the reduction rate of all stitches after trailing edge detection is made variable.

Further, the invention is not necessarily limited to the first to third examples, and may be embodied by modes of operation shown in FIG. 25 to FIG. 27. An example shown in FIG. 25 represents the case wherein a reduction rate of any stitch (last stitch, for example) after trailing edge detection is fixed, thereby adjusting the number of stitches. Then, an example given in FIG. 26 represents the case wherein a reduction rate of any stitch (last stitch, for example) after trailing edge detection is made variable for correction, and in this case the number of stitches is not changed. Further, an example of FIG. 27 represents the case wherein all stitch lengths after trailing edge detection are changed, and thus the number of stitches is not corrected.

As described in the above illustrative examples, according to the invention, once a required width of margin to sew is set on margin setting means, and after a trailing edge is detected on detecting means, a stitch length to the margin is computed by computing means, thereby carrying out a sewing to secure the required margin to sew. Consequently, an inferior working efficiency that the margin to sew up must be set from being replaced by the number of stitches from a start point for sewing to a stop point will reasonably be removed, therefore not only the operation can be facilitated but also a correct margin to sew will be obtainable. Further, a computing operation is automatically carried out for correcting at least one of the number of stitches and the feed pitch as occasion demands, therefore a required length of margin can be secured at all times without being influenced by expansion and reduction of a work fabric.

In each example described above, the corrections are carried out according to a reduction of the stitch length (feed pitch), however, it can be expanded reversely therefor. What is essential is that the correction will be applied so as to stop a needle at a point where a margin to sew is set, for which any mode is effective.

As many apparently widely different embodiments of the invention may be made without departing from the spirit and scope thereof, it is to be understood that the invention is not limited to the specific embodiments thereof except as defined in the appended claims.

What is claimed is:

1. A sewing machine, comprising:

stitch forming devices including a needle reciprocated across a work supporting surface according to rotation of a main shaft;

work feeding means actuated synchronously with rotation of said main shaft and for intermittently feeding a work fabric on said work supporting surface;

detecting means disposed on the upstream side of the reciprocating path of said needle for detecting trailing edges of said work fabric;

storing means for storing a distance between said detecting means and the reciprocating path of said needle;

setting means for setting a margin width from the trailing edge of said work fabric to a sewing end position;

means for computing a terminal stitch length after detection by said detecting means by subtracting said margin width set by said setting means and the product of the feed pitch and the feed ratio from said distance set by said storing means; and control means for controlling a sewing operation to be carried out for the sewing operation corresponding to said terminal seam length computed by said computing means.

2. A sewing machine according to claim 1, wherein said computing means include means for computing the number of stitches at the terminal stitch length by dividing the subtracted value by a feed pitch by the work feeding means.

3. A sewing machine according to claim 1, wherein said setting means include means for making the margin width variable.

4. A sewing machine according to claim 1, comprising means for storing a terminal stitch length data computed by said computing means, said control means controlling the sewing operation to be carried out in accordance with said stored data, and revising means for revising a margin data after the sewing of the terminal stitch length ends.

5. A sewing machine according to claim 4, wherein said control means include means for carrying out the sewing operation so as to drop the needle onto a final position of the terminal stitch length according to the revised margin data after revision.

6. A sewing machine, comprising:

stitch forming devices including a needle reciprocated across a work supporting surface according to rotation of a main shaft;

work feeding means actuated synchronously with rotation of said main shaft and for itnermittently feeding a work fabric on said work supporting surface;

feed adjusting means for adjusting a feed pitch by said work feeding means to a basic pitch and other pitches;

a data regulating means for regulating data corresponding to the feed pitch adjusted by said feed adjusting means;

detecting means disposed on the upstream side of the reciprocating path of said needle, for detecting the trailing edge of said work fabric;

storing means for storing a distance between said detecting means and the reciprocating path of said needle;

setting means for setting a margin width from said trailing edge of said work fabric to a sewing end position;

first computing means for computing a distance data between a point detected by said detecting means and a sewing end point, for subtracting said margin width set by said setting means from said distance set by said storing means at the point in time when said detecting means detect a trailing edge, and for computing the number of sewn stitches after the trailing edge detection by said detecting means according to said computed distance data by said first computing means and a feed pitch data regulated by said feed pitch data regulating means;

second computing means for computing so as to correct at least one of the number of stitches and the feed pitch according to a size of a remainer of a division, as occasion demands, where a remainder occurs as the result of operation by said first computing means, thereby changing an acutal sewing end position close to and/or coincidental to said sewing end position set by said setting means; and control means for controlling the sewing to be carried out to said set sewing end position according to a result computed by said first and second computing means.

7. A sewing machine according to claim 6, wherein said the second computing means include means for correcting the operation so as to reduce the feed pitch when a remainder occurs as the result of operation by said first computing means.

8. A sewing machine according to claim 7, comprising means for setting a value of the corrected number of stitches, said second computing means including means for computing so as to reduce and equalize the feed pitch of said corrected number of stitches of the sewn stitches.

9. A sewing machine according to claim 7, wherein said second computing means include means for determining a reduction rate of the feed pitch and also for computing the corrected number of pitches correlatively therewith.

10. A sewing machine according to claim 7, wherein said second computing means include means for reducing the feed pitch corresponding to one stitch.

11. A sewing machine according to claim 7, wherein said second computing means include means for reducing the feed pitch corresponding to all stitches.

12. A sewing machine, comprising:

stitch forming devices including a needle reciprocated across a work supporting surface according to rotation of a main shaft;

work feeding means actuated sysnchronously with rotation of said main shaft and for intermittently feeding a work fabric on said work supporting surface;

means for regulating the feed pitch of the work feeding means;

means for detecting a basic feed pitch regulated by said regulating means;

detecting means disposed on an upstream side of the reciprocating path of said needle, for detecting the trailing edge of said work fabric;

storage means for storing a distance between a sewing position of said needle and a detecting position of said work fabric trailing edge detecting means;

setting means for setting a margin width from the trailing edge of the work fabric to a desired sewing end position on the work fabric;

first computing means for computing a remaining partial feed length between the reciprocating path of said needle corresponding to the sensing point of said work fabric and the next dropping point of said needle;

second computing means for computing a terminal seam length by subtracting said margin width and said partial feed length from said distance stored in said storage means;

third computing means for computing a number of stitches to sew at said basic feed pitch, based upon the value computed by dividing said terminal seam length by said basic feed pitch and a fixed corrected number of plural stitches;

fourth computing means for computing the value of said corrected feed pitch by subtracting a seam length which is formed by said basic feed pitch and said number of stitches by said third computing means from said terminal seam length and dividing the subtracted value by said fixed corrected number of plural stitches;

control means for controlling said pitch regulating means in accordance with said number of stitches computed by the third computing means and said corrected feed pitch computed by the fourth computing means and for stopping the sewing machine upon completing said predetermined corrected number of stitches.

13. A sewing machine, comprising:

stitch forming devices including a needle reciprocated across a work supporting surface according to rotation of a main shaft;

work feeding means actuated synchronously with rotation of said main shaft for intermittently feeding a work fabric on said work supporting surface;

means for regulating the feed pitch of the work by the feeding means;

means for detecting a basic feed pitch regulated by said regulating means;

detecting means disposed on an upstream side of the reciprocating path of said needle for detecting a trailing edge of said work fabric;

storage means for storing a distance between a sewing position of said needle and a detecting position of said work fabric trailing edge detecting means;

setting means for setting a margin width from the trailing edge of the work fabric to a desired sewing end position on the work fabric;

first computing means for computing a remaining partial feed length between the reciprocating path of said needle corresponding to the sensing point of said work fabric and the next dropping point of said needle;

second computing means for computing a terminal seam length by subtracting said margin width and said partial feed length from said distance stored in said storage means;

third computing means for computing a number of stitches for sewing by said basic feed pitch and a corrected number of stitches for sewing by fixed corrected feed pitch, based upon a quotient of dividing said terminal seam length by said basic feed pitch and a remainder of said division;

control means for controlling the feed pitch regulating means according to said number of stitches computed by said third computing means and said fixed corrected feed pitch, and for stopping the sewing machine upon completing the sewing by said fixed corrected feed pitch.

14. A sewing machine, comprising:

stitch forming devices including a needle reciprocated across a work supporting surface according to rotation of a main shaft;

work feeding means actuated synchronously with rotation of said main shaft for intermittently feeding a work fabric on said work supporting surface;

means for regulating the feed pitch of the work feeding means;

means for detecting a basic feed pitch regulated by said regulating means;

detecting means disposed on an upstream side of the reciprocating path of said needle for detecting a trailing edge of said work fabric;

storage means for storing a distance between a sewing position of said needle and a detecting position of said work fabric trailing edge detecting means;

setting means for setting a margin width from the trailing edge of the work fabric to a desired sewing end position on the work fabric;

first computing means for computing a remaining partial feed length between the reciprocating path of said needle corresponding to the sensing point of said work fabric and the next dropping point of said needle;

second computing means for computing a terminal seam length by subtracting said margin width and said partial feed length from said distance stored in said storage means;

means for dividing said terminal seam length by said basic feed pitch;

means for discriminating a remainder of a quotient resulting from the division as zero;

means for setting said quotient as the number of stitches in the basic feed pitch and setting stitches in the corrected feed pitch as zero, in case said remainder is discriminated as zero; and means for computing stitches of the terminal seam length in a fixed corrected feed pitch in accordance with said quotient and remainder in case said remainder is not discriminated as zero.

15. A sewing machine, comprising:

stitch forming devices including a needle reciprocated across a work supporting surface according to rotation of a main shaft;

work feeding means actuated synchronously with rotation of said main shaft for intermittently feeding a work fabric on said work supporting surface;

means for regulating the feed pitch of the work feeding means;

means for detecting a basic feed pitch regulated by said regulating means;

detecting means disposed on an upstream side of the reciprocating path of said needle for detecting a trailing edge of said work fabric;

storage means for storing a distance between a sewing position of said needle and a detecting position of said work fabric trailing edge detecting means;

setting means for setting a margin width from the trailing edge of the work fabric to a desired sewing end position on the work fabric;

first computing means for computing a remaining partial feed length between the reciprocating path of said needle corresponding to the sensing point of said work fabric and the next dropping point of said needle by multiplying the feed pitch by the feed ratio;

second computing means for computing a terminal seam length by subtracting said margin width and said partial feed length from said distance stored in said storage means;

third computing means for computing the number of stitches of the terminal seam length in dependence upon the value dtermined by dividing the terminal seam length by said basic feed pitch detected by the feed pitch detecting means;

fourth computing means for computing the feed pitch so as to equalize the length of all stitches in the terminal seam; and control means for controlling the feed pitch regulating means according to the feed pitch computed by the fourth computing means and for stopping the sewing machine after completing the sewing of the number of stitches computed by the third computing means.

16. A sewing machine, comprising:

stitch forming devices including a needle reciprocated across a work supporting surface according to rotation of a main shaft;

work feeding means actuated synchronously with rotation of said main shaft for intermittently feeding a work fabric on said work supporting surface;

detecting means disposed on an upstream side of the reciprocating path of said needle for detecting a trailing edge of said work fabric;

storage means for storing a distance between said detecting means and the reciprocating path of said needle;

setting means for setting a margin width from the trailing edge of said work fabric to a sewing end position on said work fabric;

means for computing a terminal seam length after detection by said detecting means by subtracting said margin width set by said setting means from said distance set by said first storage means;

control means for controlling a sewing operation to be carried out for the sewing operation corresponding to said terminal seam length computed by said computing means;

revising means for revising margin data after the sewing of terminal seam length.

17. A sewing machine according to claim 16, wherein said control means include means for carrying out the sewing operation so as to drop the needle at a final position of the terminal seam length according to the revised margin data after revision.

* * * * *